United States Patent [19]

Miller

[11] 4,038,758

[45] Aug. 2, 1977

[54] GRAIN DRYER

[76] Inventor: Russell A. Miller, 1412 W. Woodside Drive, Dunlap, Ill. 61525

[21] Appl. No.: 665,917

[22] Filed: Mar. 11, 1976

Related U.S. Application Data

[63] Continuation-in-part of Ser. No. 618,004, Sept. 30, 1975, abandoned.

[51] Int. Cl.[2] ..... F26B 19/00

[52] U.S. Cl. ..... 34/48; 34/54; 34/86; 34/174; 34/232; 56/12.2

[58] Field of Search ..... 54/12.8, 12.2; 34/48, 34/54, 218, 232, 233, 174; 219/364, 368, 370, 373, 374, 375

[56] References Cited

U.S. PATENT DOCUMENTS

| | | | |
|---|---|---|---|
| 994,259 | 6/1911 | Kazanjian | 219/374 |
| 1,658,775 | 2/1928 | Campbell | 130/27 |
| 2,722,058 | 11/1955 | Heal | 34/232 |
| 3,096,165 | 7/1963 | Lane | 34/183 |
| 3,581,407 | 6/1971 | Ward et al. | 56/12.2 |
| 3,600,823 | 8/1971 | Borron et al. | 34/232 |
| 3,636,638 | 1/1972 | Noyes | 34/48 |

FOREIGN PATENT DOCUMENTS

| | | | |
|---|---|---|---|
| 709,569 | 5/1965 | Canada | 56/12.2 |
| 784,861 | 10/1957 | United Kingdom | 34/174 |

*Primary Examiner*—Kenneth W. Sprague
*Assistant Examiner*—James C. Yeung
*Attorney, Agent, or Firm*—Shoemaker and Mattare, Ltd.

[57] ABSTRACT

A grain dryer for drying grain crops as they are harvested, comprising a combine having a grain storage bin and a grain dryer supported on the bin and having an air discharge portion extending into the bin and an air intake portion external of the bin, heater elements in the dryer for heating the air discharged therefrom and control elements connected with the dryer to control the flow of air therethrough and the temperature to which the air is heated.

17 Claims, 8 Drawing Figures

GRAIN DRYER

BACKGROUND OF THE INVENTION

This application is a continuation-in-part of application Ser. No. 618,004, filed Sept. 30, 1975, entitled GRAIN DRYER, now abandoned.

This invention relates to grain dryers, and in particular, to a grain dryer which is used in combination with a combine or like harvester to dry the grain as it is harvested.

The moisture content of grain coming out of a field as it is harvested varies between about 18% and 30%. In order for the grain to be stored, the moisture content thereof should be reduced to about 16.5%, and in order to be sold and shipped directly to a customer, the grain should have a moisture content of only about 14.5%.

In the prior art, grain is dried at storage bins or hoppers after it has been combined and transported out of the field, and accordingly, extra handling of the grain and additional time are required in order to harvest it, dry it and supply it to a customer or place it in a grain storage elevator or the like. As a consequence, the cost of the grain to the consumer in increased.

In accordance with the present invention, a grain dryer is provided in combination with a combine, so that the grain is dried to a desired level as it is being harvested, and accordingly, the grain is ready for immediate sale and shipment or storage without further drying being performed thereon, and the excessive handling of the grain and additional time required in the prior art are thus eliminated, with the result that the cost of the grain to the ultimate consumer can be less or held to a minimum.

OBJECTS OF THE INVENTION

It is an object of this invention to provide a grain dryer for drying grain as it is being harvested.

Another object of the invention is to provide a combine and grain dryer in combination, wherein the dryer is supported on the bin of the combine for drying the grain as it is harvested and introduced into the bin.

A further object of the invention is to provide in combination, a grain combine and grain dryer, wherein the grain dryer discharges heated air through grain in the grain storage bin of the combine to dry the grain.

DETAILED DESCRIPTION OF THE PREFERRED EMBODIMENTS

Figure 1:
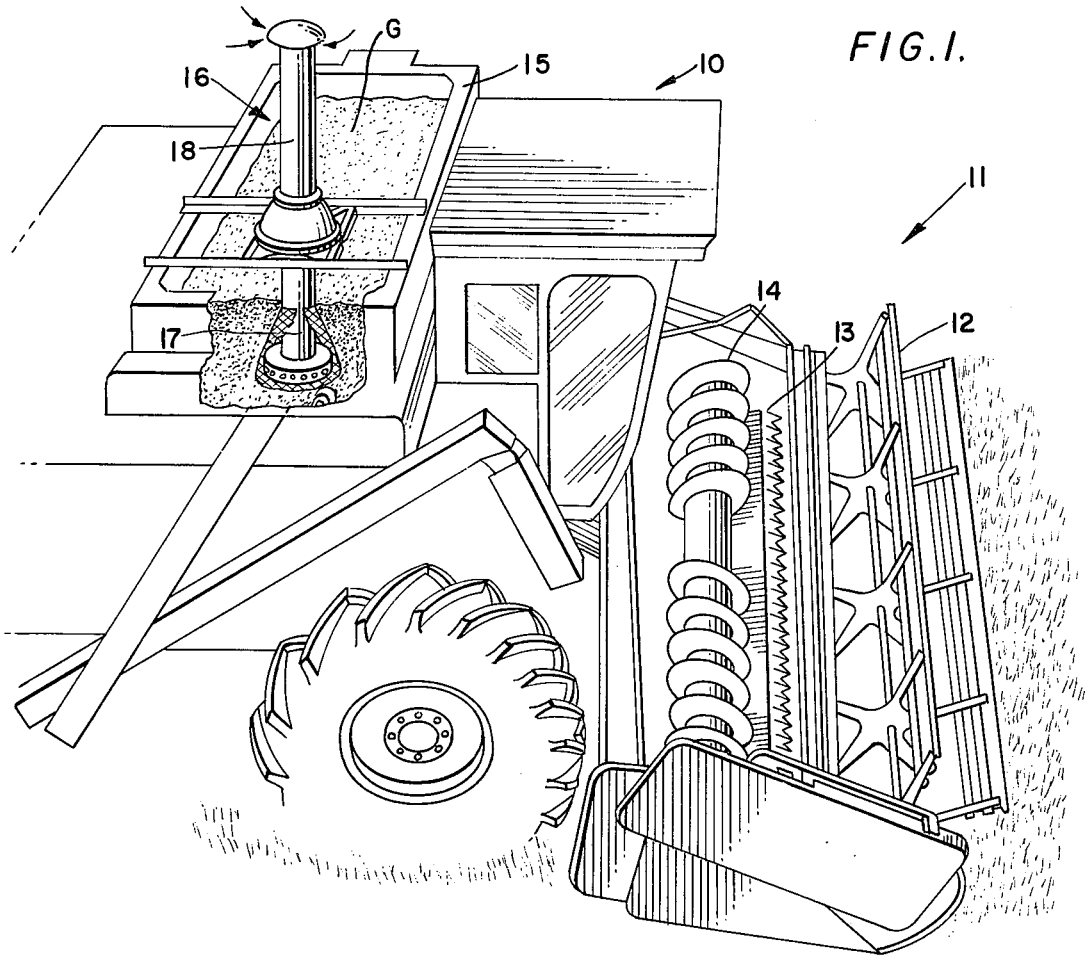
FIG. 1 is a perspective view, with portions thereof broken away, showing a typical combine in combination with a grain dryer according to the invention.
Figure 2:
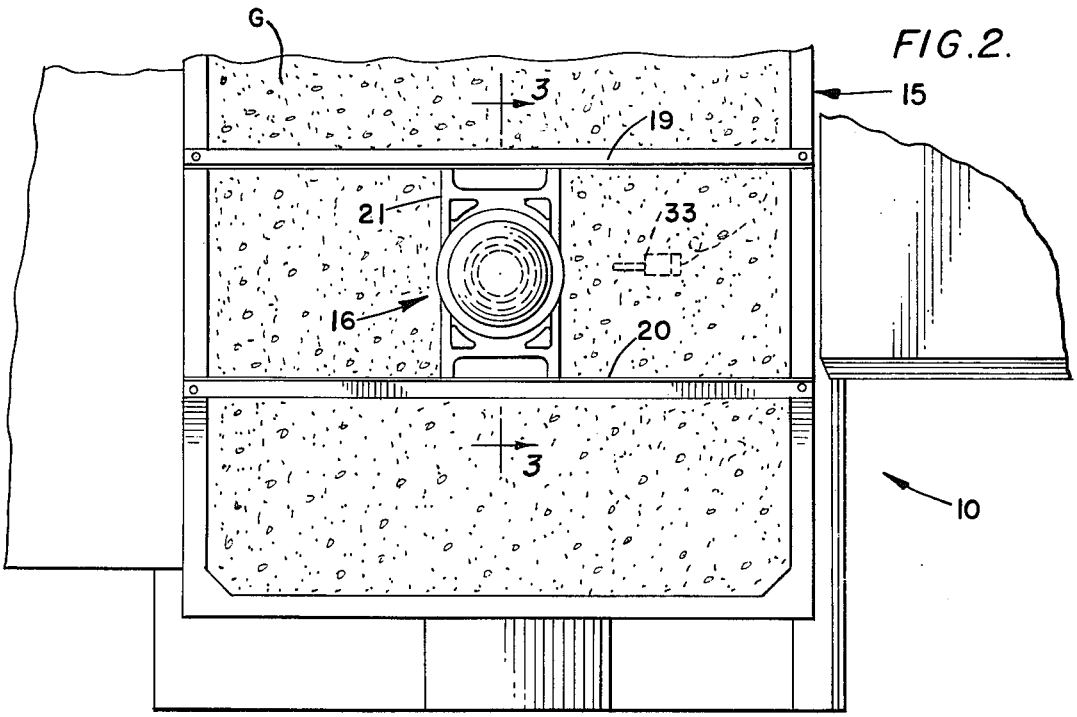
FIG. 2 is a greatly enlarged, fragmentary plan view of a portion of the bin of the combine of FIG. 1, showing the position of the grain dryer therein.

In the drawings, wherein like reference numerals indicate like parts throughout the several views, a grain combine of conventional construction is indicated generally at 10 in FIG. 1 and comprises a header 11 having a rotatable reel 12, sickle and cutter bar 13 and header auger 14 for cutting and feeding the grain to the combine. The grain is thrashed in the combine in a conventional manner and fed to a bin 15 of conventional construction.

A dryer 16 in accordance with the invention is supported on the bin 15 and has an air discharge portion 17 extending into the grain G within the bin, and an air intake portion 18 projecting upwardly above the bin. The dryer 16 is operatively supported relative to the bin by means of a pair of angle irons 19 and 20 spanning the width of the bin and secured at their opposite ends to the upper edges thereof and having a dryer support frame or bracket 21 secured thereto between the ends thereof and extending transversely between the angle irons in supporting relationship to the dryer 16.

Figure 3:
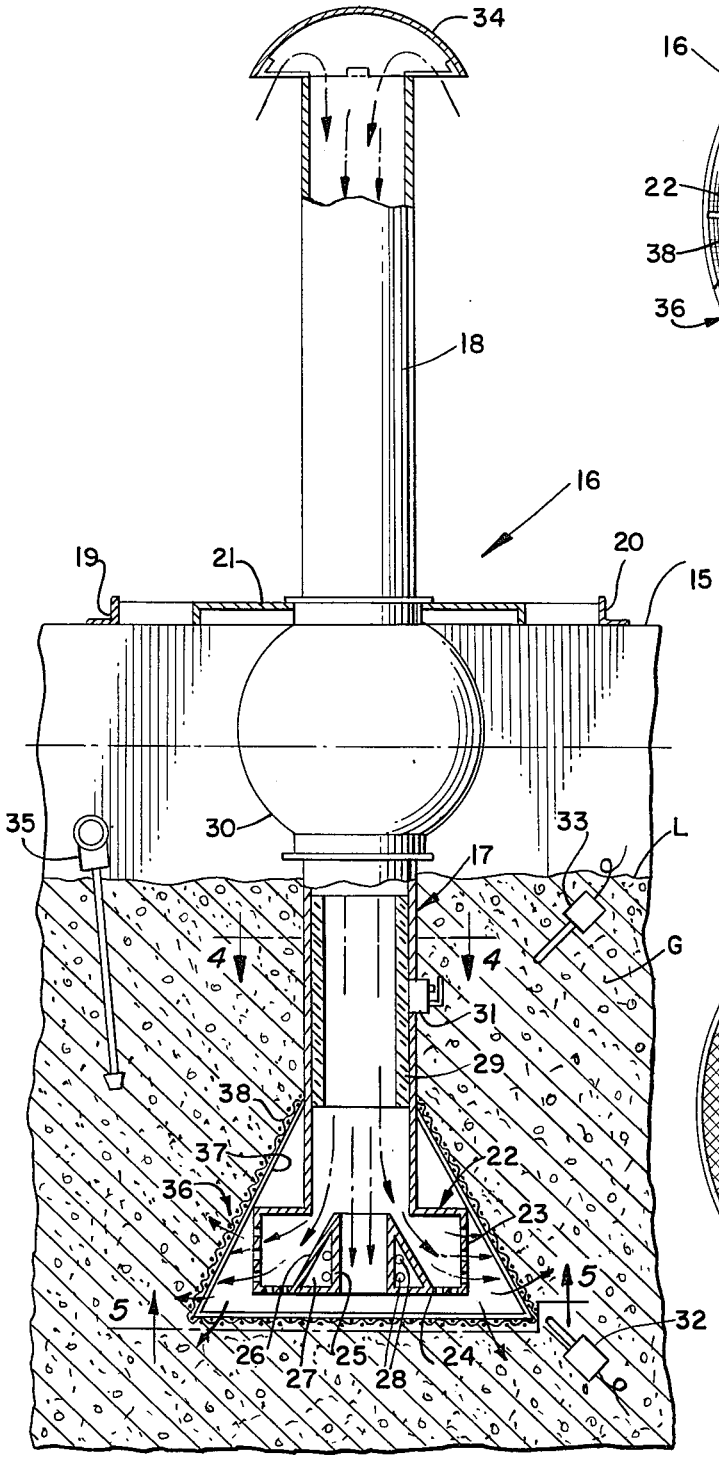
FIG. 3 is an enlarged, fragmentary, sectional view taken along line 3—3 in FIG. 2.
Figure 4:
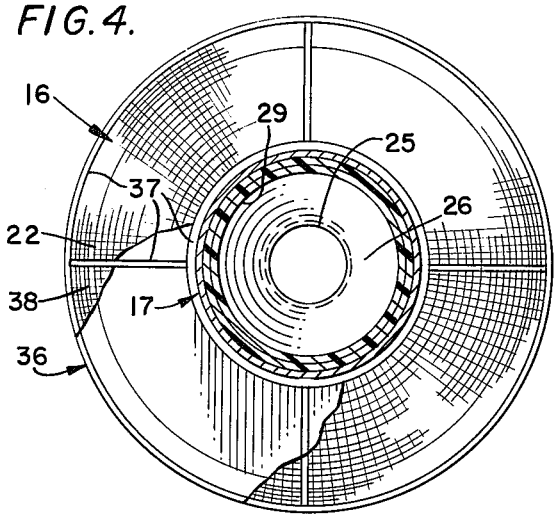
FIG. 4 is an enlarged view in section taken along line 4—4 of FIG. 3.
Figure 5:
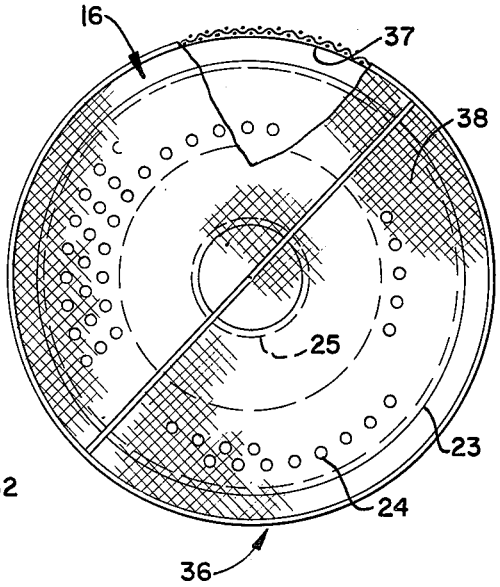
FIG. 5 is an enlarged view taken along line 5—5 in FIG. 3.

As seen best in FIG. 3, the air discharge portion 17 and air intake portion 18 are elongate, cylindrical, tubular members, and in a preferred embodiment, they are made of galvanized steel or the like. The air discharge portion 17 has a perforated, diametrically enlarged air discharge header 22 secured thereto and comprising a cylindrical, perforated wall 23 for directing heated air radially outwardly into the grain G and also having perforations in a bottom wall 24 thereof for directing heated air axially into the grain G. Secured within the discharge header is a housing comprising an inner cylindrical wall 25 and an outer frustoconical wall 26 secured together to define an annular space 27 of triangular cross-sectional configuration. The walls 25 and 26 are preferably made of stainless steel. Suitable heating elements, such as Calrod heating coils or the like, 28 are disposed in the space 27 for heating air flowing downwardly through the opening defined by the inner wall 25 and outwardly over the surface of the conical wall 26 and thence through the perforated walls 23 and 24.

A suitable heating element 29 is secured within the air discharge tube or portion 17 between the ends thereof and comprises a sleeve-like liner of the type sold under the trade name of Briskeat, manufactured by Briscoe Manufacturing Company of Columbus, Ohio.

A suitable blower means 30 is mounted between the air intake portion 18 and air discharge portion 17 and may, for example, be of the type manufactured by Loren Cook Company, Springfield, Mo., and having Catalogue No. 10CV and having a two-speed motor. A pressure switch 31 of suitable conventional construction is carried by the air discharge tube or portion 17 in a position approximately halfway between the lower air discharge end portion thereof and the blower 30, such that when the depth of grain G within the bin 15 reaches a predetermined level, as indicated, for example, at L in FIG. 3, the switch is activated to switch the motor of fan 30 to a high speed.

Also, a pair of thermostatic control means 32 and 33 are mounted in the bin in a position to be disposed adjacent the air discharge portion, as depicted in FIG. 3, for example, and operatively connected with the sleeve-type heating element 29 and heating coils 28 to maintain a temperature in the grain at the locations of the thermostatic control devices of between about 180° F and 220° F.

A shroud 34 is secured on the open upper end of air intake portion 18 for preventing entry of rain and the like into the air intake.

In use, the dryer is operatively supported on the bin 15 of a combine, as illustrated in FIG. 1, and the combine is used to harvest grain. The grain is thrashed in a conventional manner and is fed to the bin 15 with the lower end of the air discharge portion of the dryer becoming submerged in the grain relatively quickly. In other words, the depth of a typical bin on a combine is about 4 feet, and the air discharge portion of the dryer extends downwardly into the bin about 3 feet, or in other words, is spaced upwardly from the bottom of the bin about 1 foot. Thus, the discharge of heated air occurs into the grain near the bottom thereof for circulation of the heated air outwardly and upwardly through the grain to effect thorough and complete drying thereof.

As noted previously, the moisture content of grain coming out of the field or as harvested may vary between about 18% and 30%, and for the lower moisture contents, only the sleeve-type heater 29 is energized to heat the air flowing downwardly through the tube 17. Also, during normal operation and prior to the time the grain reaches a predetermined depth, as indicated, for example, by level L in FIG. 3, the blower motor for blower 30 is operating at a low speed sufficient to circulate air effectively through the grain. However, in the event the moisture content of the grain is relatively high, as, for example, approaching 30%, as sensed by humidistat or the like 35 inserted into the grain, then the lower heating elements 28 are also energized to futher heat the air being discharged from the air discharge portion. Also, the blower motor is operated at a high speed under these conditions to circulate a maximum amount of heated air through the grain. Further, when the level of the grain reaches a predetermined level L sufficient to operate switch 31, the blower motor is operated to its high speed and both of the heating elements are energized.

A typical dryer in accordance with the invention weighs approximately 100 pounds and has an overall length of about 6 feet. Also, the sleeve heating element 29 is capable of being heated to a temperature of about 900° F, and the coil 28 is heated to a temperature of about 750° F.

In order to prevent the grain from coming into contact with hot surfaces of the dryer, a perforated screen or shield 36 may be secured over the discharge header 22 of the dryer. The screen 36 comprises an open wire frame 37 having a suitable, porous or perforated screen material 38 secured thereover. Thus, the screen 36 does not restrict the flow of heated air into the grain to dry the grain, but it does prevent burn damage to the grain by keeping it spaced from the hot surfaces of the dryer.

The power supply for the dryer is taken from a suitable portable alternator, not shown, driven from the engine of the combine, and of the type sold, for example, by Generac of Waukesha, Wis.

Figure 6:
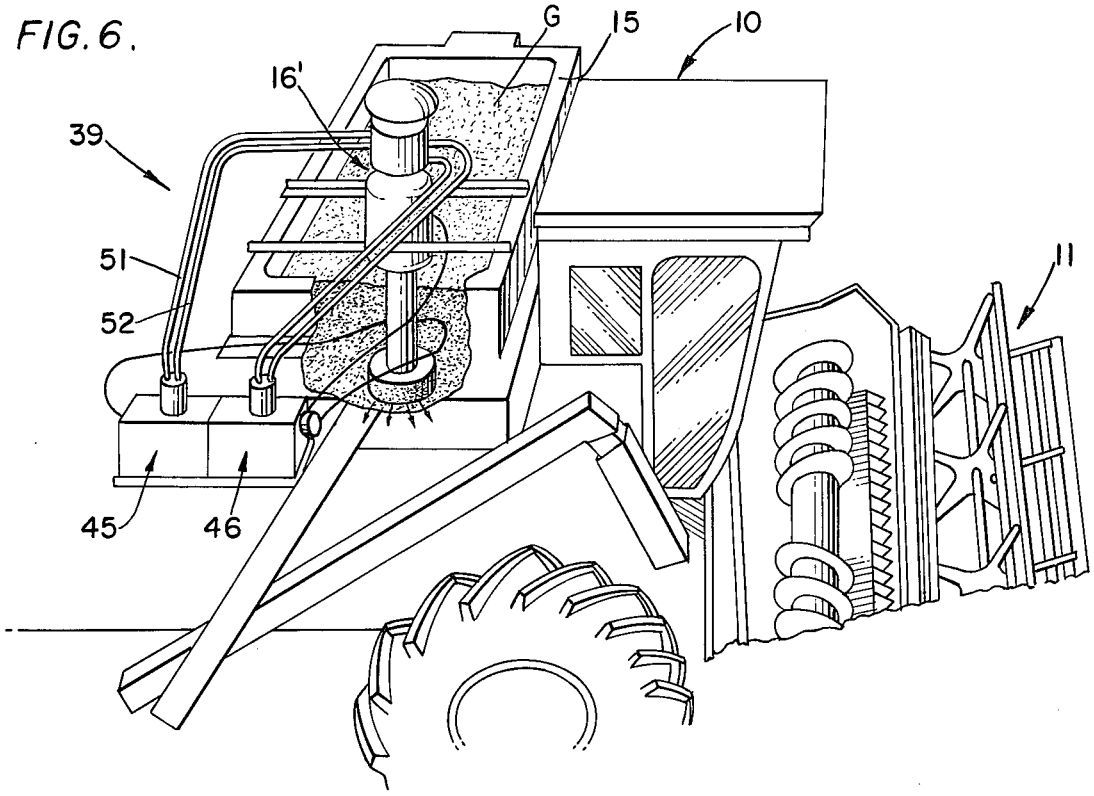
FIG. 6 is an enlarged, fragmentary, perspective view of a combine and grain dryer according to a second form of the invention, wherein the dryer utilizes two sources of power, and uses hot water radiators to preheat the air.
Figure 7:
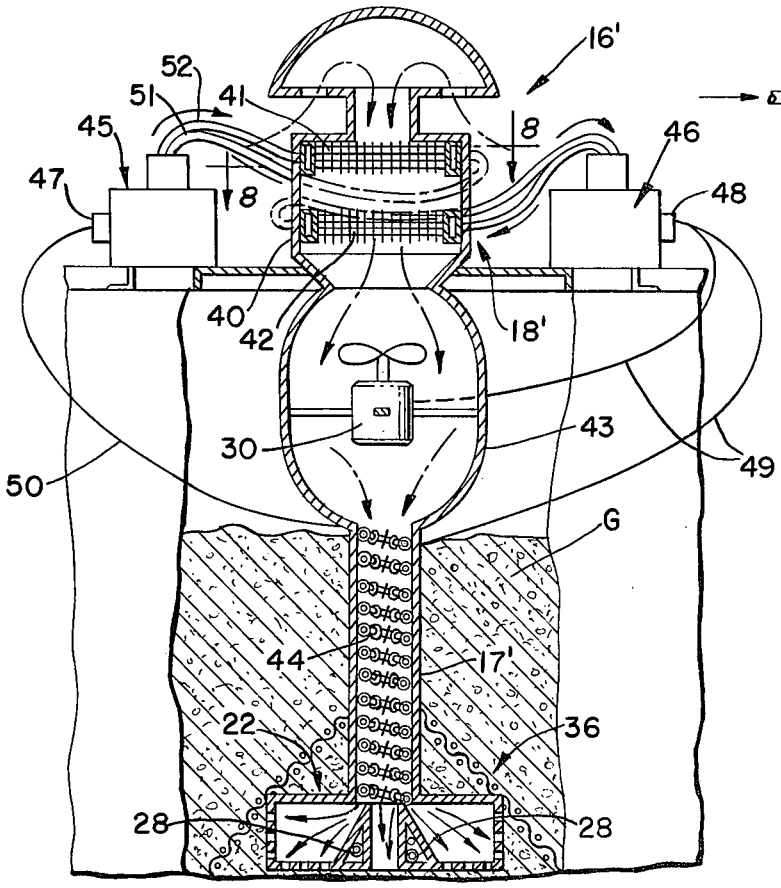
FIG. 7 is an enlarged, fragmentary view in section of the dryer according to the second form of the invention.
Figure 8:
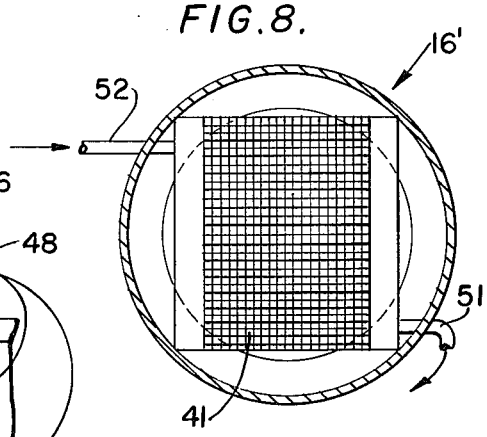
FIG. 8 is an even further enlarged view in section, taken along line 8—8 in FIG. 7.

A second form of grain dryer and combine combination 39 is shown in FIGS. 6–8, and in this form of the invention, the dryer 16' includes a lower, air discharge portion 17' and an air intake portion 18'. The dryer 16' is supported relative to the bin 15 just as in the previous embodiment, and includes a shroud 34 on the upper, air intake end thereof.

However, in this form of the invention, the intake portion 18' is diametrically enlarged at 40, defining a preheater section just below the shroud 34, and a pair of substantially identical, spaced apart hot water radiators 41 and 42 are supported therein. The radiators are of conventional construction, and include means for circulation of hot water therethrough, whereby air passing through the radiators is heated.

The blower 30 is mounted in an enlarged portion 43 of the dryer, just below the preheater section 40, for drawing atmospheric air through the intake end and through the radiators, and then discharging it through the air discharge portion 17'.

A finned heating coil 44, of a suitable electrical resistance element, is disposed in the discharge portion 17', rather than the sleeve 29 in the previously described form of the invention.

Further, a pair of auxiliary engines 45 and 46 are supported on the combine, and the engines may be of any suitable type, such as, for example, 4 cylinder water cooled engines, developing about 12 horsepower, and driving 16 kw generators or alternators or the like 47 and 48. One of the alternators is connected via wires 49 with the blower motor 30 and with the finned heating element 44, and the other alternator is connected via wires 50 with the finned heating element 44. The heating elements 28 are also connected to be energized by the alternators.

Additionally, the radiators 41 and 42 are connected via hoses or pipes and the like 51, 52 to circulate water from the blocks of the engines 45 and 46, to cool the engines and at the same time provide a source of heat for heating the air prior to contact with finned Calrod heating element 44.

In all other respects, this form of the invention is identical to that previously described, including the thermostats and humidistat and the like.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. In combination, a combine or the like for harvesting grain crops and having a grain storage bin thereon, and a grain dryer associated with the grain storage bin for drying the grain crops as they are harvested, said grain dryer supported on the bin and having an air discharge portion extending into the bin and an air intake portion external of the bin, heater means in the dryer in a position to heat air flowing through the dryer and discharged therefrom, and control means connected with the dryer to control both the flow of air therethrough and the temperature of the heated air discharged from the dryer, said air discharge portion normally being disposed below the surface and within grain stored or held in the bin, and comprising at its lower end an air discharge header having openings in the side thereof and openings in the bottom thereof, for flow of heated air both radially outwardly and axially downwardly into the grain, whereby heated air discharged from the discharge end of the dryer is circulated outwardly and upwardly through the grain in the bin to dry the grain.

2. The combination as in claim 1, wherein the dryer comprises elongate, tubular air intake and air discharge portions extending upwardly from the top of the bin and downwardly into the bin, respectively, and elongate dryer support members secured to and extending across the top of the bin and engaged with the dryer to support the dryer in upright postion.

3. The combination as in claim 2, wherein the air intake portion comprises an elongate, tubular member having an open upper end, a blower means connected with the lower end of the air intake portion, and said air discharge portion comprising an elongate, tubular member connected at an upper end thereof to the discharge from the blower means and extending downwardly therefrom and having an open lower end.

4. The combination as in claim 3, wherein the air discharge header is diametrically enlarged relative to the tubular discharge portion and includes a perforated cylindrical side wall and a perforated annular bottom wall surrounding a central opening aligned with the tubular air discharge portion.

5. The combination as in claim 4, wherein a sleeve-type heating element is disposed coaxially within the tubular air discharge portion for heating air flowing therethrough.

6. The combination as in claim 5, wherein said perforated air discharge header includes a cylindrical, reduced diameter inner wall disposed coaxially therewithin, and a conically-shaped outer wall secured to the inner wall and extending downwardly and outwardly from the upper end thereof and defining an annular space of triangular cross-sectional configuration, and heating elements positioned in said space for heating air flowing downwardly through the inner wall and over the conical wall.

7. The combination as in claim 6, wherein pressure switch means are supported on the air discharge portion in a position to be covered with grain in the bin when the grain reaches a predetermined level and operated by the pressure of the grain to control the speed of operation of the blower.

8. The combination as in claim 7, wherein thermostatic control elements are positioned in the bin in a position adjacent the sleeve-type heating element and adjacent the perforated air discharge header and disposed to be covered with grain in the bin and operatively connected with the heating elements in the air discharge portion of the dryer to control energization thereof to maintain the temperature in the grain adjacent the thermostatic control elements between about 180° F and 220° F.

9. The combination as in claim 1, wherein a porous shield is secured over the discharge header to keep the grain spaced from hot surfaces of the dryer to thus prevent burn damage to the grain but at the same time to enable relatively unrestricted flow of heated air into the grain to dry the grain.

10. The combination as in claim 3, wherein the air intake portion comprises a preheater section and includes heater means therein for preheating air to be discharged by the dryer.

11. The combination as in claim 10, wherein radiator means is supported in the preheater section in the path of air moving through the dryer, and means is connected therewith for circulating hot water therethrough to preheat the air.

12. The combination as in claim 11, wherein water cooled engine means is supported on the combine, and the radiators are connected to receive water circulated through the engine means to cool the engine means and also heat the air for drying the grain.

13. The combination as in claim 12, wherein electrical energy generating means is connected with the engine means to be driven thereby.

14. The combination as in claim 13, wherein electrical resistance heating elements are disposed in the air discharge portion of the dryer for heating air to be discharged from the dryer, said electrical energy generating means connected to supply electrical energy to the electrical heating element means.

15. The combination as in claim 14, wherein the electrical resistance heating elements include a finned coil in the air discharge portion.

16. The combination as in claim 11, wherein the radiator means comprises a pair of radiators supported one above the other in spaced apart relationship.

17. The combination as in claim 12, wherein the engine means comprises a pair of auxiliary engines, each connected with a respective radiator means.

* * * * *